US006137277A

United States Patent [19]

Rajda et al.

[11] Patent Number: 6,137,277

[45] Date of Patent: Oct. 24, 2000

[54] STATIC VOLTAGE REGULATOR

[75] Inventors: Janos Rajda, Mississauga; Shashi Dewan, Toronto; Rusong Wu; Jianping Li, both of Etobicoke, all of Canada

[73] Assignee: Inverpower Controls Ltd., Burlington, Canada

[21] Appl. No.: 09/429,622

[22] Filed: Oct. 29, 1999

[51] Int. Cl.[7] ..... G05F 5/00; G05F 1/16; G05F 1/26

[52] U.S. Cl. ..... 323/301; 323/258; 323/263

[58] Field of Search ..... 323/301, 299, 323/247, 258, 263

[56] References Cited

U.S. PATENT DOCUMENTS

| | | | |
|---|---|---|---|
| Re. 31,325 | 7/1983 | Crapo | 323/263 |
| 3,551,789 | 12/1970 | Baker et al. | 323/258 |
| 3,582,765 | 6/1971 | McCabe | 323/263 |
| 3,600,664 | 8/1971 | Goldberg | 323/263 |
| 3,600,668 | 8/1971 | Goldberg | 323/263 |
| 3,621,375 | 11/1971 | Kettler | 323/262 |
| 3,706,024 | 12/1972 | Wood | 323/258 |
| 3,732,485 | 5/1973 | Kettler | 323/263 |
| 3,732,486 | 5/1973 | Schoendube | 323/263 |
| 4,178,539 | 12/1979 | Crapo | 323/262 |
| 4,286,207 | 8/1981 | Spreadbury et al. | 323/263 |
| 4,896,092 | 1/1990 | Flynn | 323/258 |
| 5,075,617 | 12/1991 | Farr | 323/258 |
| 5,408,171 | 4/1995 | Eitzmann et al. | 323/258 |
| 5,545,971 | 8/1996 | Gomez et al. | 323/263 |
| 5,654,627 | 8/1997 | Shimazu et al. | 323/258 |
| 5,786,684 | 7/1998 | Bapat | 323/258 |

*Primary Examiner*—Peter S. Wong
*Assistant Examiner*—Bao Q. Vu
*Attorney, Agent, or Firm*—Robert J. Graham; Gowling Lafleur Henderson LLP

[57] ABSTRACT

A static voltage regulator consists of a booster transformer, a regulator transformer, an electronic switching system and a control system. The booster transformer includes a booster primary winding and a booster secondary winding. The booster secondary is provided in series with the input and output terminals of the regulator so as to produce an output voltage. The regulator transformer includes a regulator primary winding and a regulator secondary winding. The regulator primary is electrically coupled to the output. The electronic switching system is coupled between the regulator secondary and the booster primary for providing a voltage to the booster primary. The control system includes a voltage sensor for sensing a voltage at the input, and a gating system coupled to the switching system for switching the output voltage in response to changes in the sensed input voltage. The voltage regulator also includes a notch filter coupled to the booster transformer for reducing transients induced in the booster transformer when the output voltage is switched.

17 Claims, 2 Drawing Sheets

100

104
102
112
124
126a
126b
126c
126d
126m
126n
114
128
130
132
110
122
120
120a
120b
118
R
L
C
116
CONTROL SYSTEM

STATIC VOLTAGE REGULATOR

FIELD OF THE INVENTION

The present invention relates to a voltage regulator which regulates the AC voltage at its load terminals in response to variations in source voltage. In particular, the present invention relates to a medium voltage voltage regulator employing a feed forward approach for regulating load voltage.

BACKGROUND OF THE INVENTION

Many commercial and industrial users of sensitive electronic and electrical equipment depend upon their power utility to supply power continuously at a reasonably constant frequency and voltage. An overvoltage or undervoltage condition (hereinafter referred to as a supply event) on the power lines feeding such high power consumers can lead to costly assembly and/or process line shutdowns and damage to sensitive electronic equipment. As a result, many medium-voltage power consumers make use of a voltage regulator to remove or substantially reduce the impact a supply event may pose upon their electronic and electrical equipment.

The conventional medium power voltage regulator consists of a booster transformer, a regulator transformer having a multi-tap secondary winding, electro-mechanical tap switches coupled between the booster transformer primary and respective taps of the regulator transformer secondary windings, and a mechanical crowbar switch connected across the booster transformer primary. The secondary of the booster transformer is connected in series with the power distribution line and a load (such as electronic equipment), and the primary of the regulator transformer is connected across the source side of the distribution line in advance of the booster transformer.

During normal line conditions, the crowbar switch is closed, causing the booster transformer to appear as a simple inductance in series with the load. Control logic monitors the load voltage, and closes one of the tap switches in response to a supply event at the load. The crowbar switch is then opened so that the voltage from the regulator transformer secondary appears across the primary of the booster transformer and becomes added to the source voltage. The particular tap switch to be closed is selected so that the voltage induced in the booster transformer secondary is of sufficient magnitude and polarity so as to counteract the supply event.

However, mechanical switches increase the maintenance costs of the conventional voltage regulator. Further, conventional voltage regulators suffer from poor response times (typically requiring several seconds to correct an undervoltage condition) due to the presence of the mechanical switches. Since industrial users of microprocessor-controlled equipment, and other power supply sensitive equipment, cannot tolerate large variations in supply voltage, the delay associated with the conventional voltage regulator is often unacceptable.

Due to the rapid response times of solid-state switches over mechanical switches, solid-state static voltage regulators (SVRs) have been developed recently as a replacement for the conventional mechanical voltage regulator. Once such voltage regulator is taught by Schoendube in U.S. Pat. No. 3,732,486, and consists of a booster transformer, a multi-tap shunt transformer, and a series of thyristor tap switches coupled between one end of the primary winding of the booster transformer and a respective tap of the shunt transformer. The other end of the primary winding of the booster transformer is connected to a half H-bridge circuit which allows the voltage regulator to operate either in boost or buck mode. The secondary winding of the booster transformer is connected in series between the input terminal and the load terminal, while the shunt transformer is connected between the input terminal and a voltage reference. The regulator includes a bypass thyristor switch connected across the booster transformer primary.

In operation, a line voltage is applied to the input terminal of the Schoendube voltage regulator. If the output voltage is within tolerance, the bypass thyristor switch is closed, thereby shorting the primary of the booster transformer and providing unity voltage gain. During undervoltage conditions, the H-bridge is configured for boost mode, and one of the tap switches is closed, causing the bypass thyristor to be commutated off and a voltage to be induced into the secondary winding of the booster transformer which adds to the voltage at the input terminal. Conversely, during overvoltage conditions, the H-bridge is configured for buck mode, and one of the tap switches is closed, causing a voltage to be induced into the secondary winding of the booster transformer which subtracts from the voltage at the input terminal. Although the voltage regulator taught by Schoendube provides a shorter response time than the conventional mechanical voltage regulator, the forced commutation of the thyristors can induce undesirable transients into the load.

Another voltage regulator with improved response time is taught by Flynn in U.S. Pat. No. 4,896,092, and consists of a booster transformer, an output transformer, and a switch matrix coupled between the output transformer and the booster transformer. The output transformer includes a primary winding, an output winding, and a multi-tap winding. The secondary winding of the booster transformer is connected in series with the input terminals and the primary winding of the output transformer, and the output winding of the output transformer is connected to the output terminals. The switch matrix comprises a series of triac switches each connected between the primary winding of the booster transformer and a respective tap of the multi-tap winding.

In operation, a line voltage is applied to the input terminals of the Flynn voltage regulator. A control circuit monitors the peak voltage at the output terminals each half cycle, and provides gating signals to the switch matrix to either boost the output voltage (when operating in boost mode) or reduce the output voltage (when operating in buck mode). However, Flynn does not address the problem of transients which might be induced into the load when the triacs are switched. Accordingly, there remains a need for a medium-voltage voltage regulator which provides a shorter response time than the conventional mechanical voltage regulator, and reduces the risk of transients being induced into the load when the load voltage is corrected.

SUMMARY OF THE INVENTION

According to the invention, there is provided a static voltage regulator which addresses the deficiencies of the prior art voltage regulators.

The static voltage regulator, according to the invention, comprises an input, an output, a booster transformer, a regulator transformer, an electronic switching system and a control system. The booster transformer includes a booster primary winding and a booster secondary winding. The booster secondary is provided in series with the input and the output so as to produce an output voltage. The regulator transformer includes a regulator primary winding and a regulator secondary winding. The regulator primary is electrically coupled to the output. The electronic switching system is coupled between the regulator secondary and the booster primary for providing a voltage to the booster primary. The control system includes a voltage sensor for sensing a voltage at the input, and a gating system coupled to the switching system for switching the output voltage in response to changes in the sensed input voltage. The voltage regulator also includes a notch filter coupled to the booster transformer for reducing transients induced in the booster transformer when the output voltage is switched.

In a preferred embodiment of the invention, the regulator secondary includes a plurality of voltage taps, the taps including a voltage boost tap for increasing the output voltage and a voltage buck tap for decreasing the output voltage. The electronic switching system comprises a plurality of electronic switches. Each switch includes a gating input for controlling a conduction interval thereof and is coupled between the booster primary and a respective one of the plurality of taps for providing one of a plurality of voltages to the booster primary. The gating system is coupled to the voltage sensor and the gating inputs for switching the output voltage in response to changes in the sensed input voltage, and is configured to open a conducting one of the electronic switches prior to closing a non-conducting one of the electronic switches.

BRIEF DESCRIPTION OF THE DRAWINGS

The preferred embodiment of the invention will now be described, by way of example only, with reference to the drawings, in which.

DETAILED DESCRIPTION OF THE PREFERRED EMBODIMENTS

Figure 1:
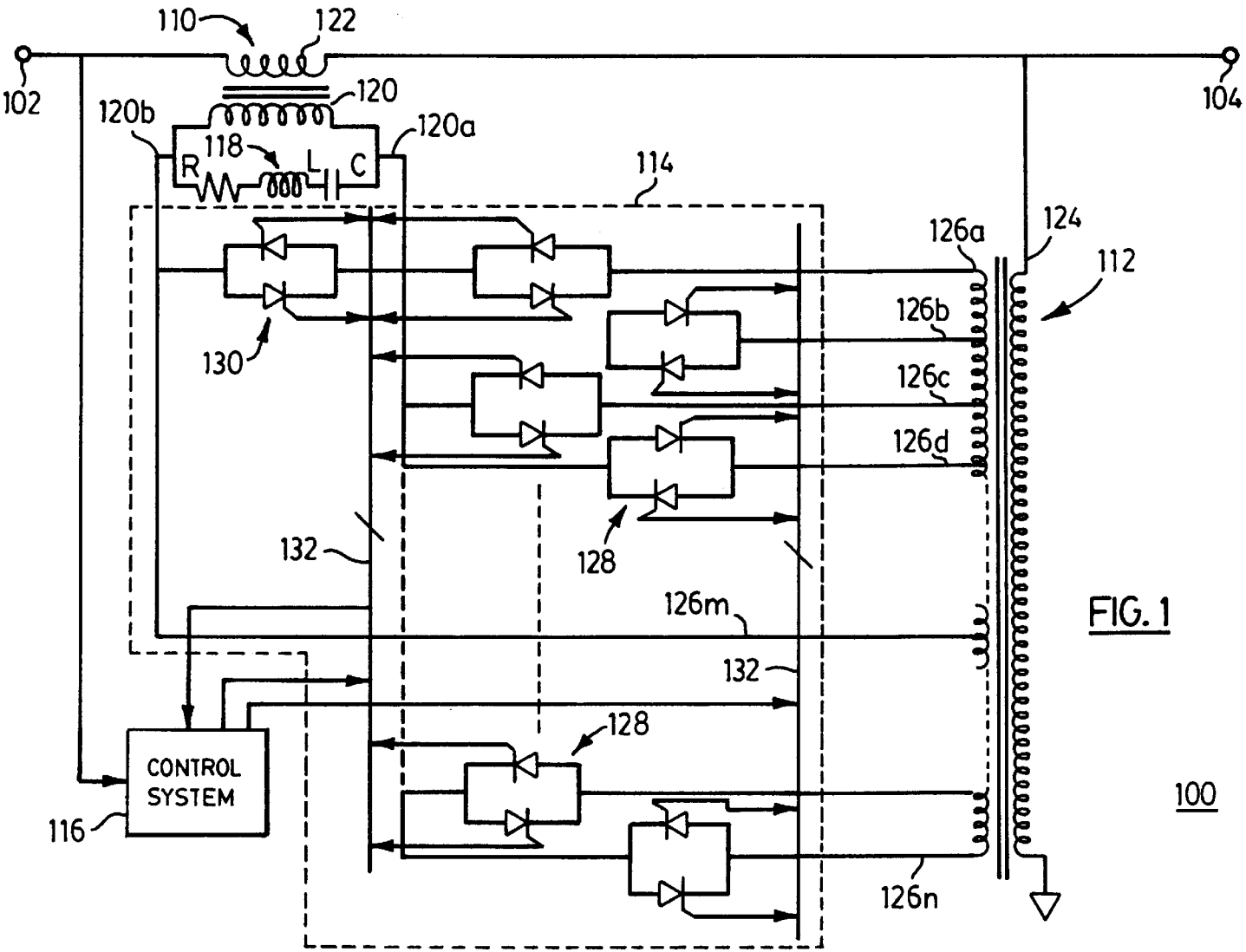
FIG. 1 is a schematic diagram of one phase of a three-phase static voltage regulator according to the present invention, depicting the booster transformer, the regulator transformer, the electronic switching system, the control system, and the notch filter.

Turning to a FIG. 1, one phase of a three-phase static voltage regulator is shown. However, it should be understood at the outset that the static voltage regulator may be implemented as a single phase, or with any other number of phases if desired. The static voltage regulator, denoted generally as 100, is shown comprising an input port 102 for coupling to a voltage source, such as a power distribution line, an output port 104 for coupling to a load (not shown), a booster transformer 110, a regulator transformer 112, an electronic switching system 114 connected between the booster transformer 110 and the regulator transformer 112, a control system 116 coupled to the switching system 114, and a notch filter 118 coupled to the booster transformer 110. The booster transformer 110 has a booster primary winding 120 and a booster secondary winding 122. The booster secondary 122 is provided in series with the input port 102 and the output port 104.

The regulator transformer 112 has a regulator primary winding 124 and a regulator secondary winding 126. The regulator primary 124 is connected to the output port 104, and the regulator secondary 126 includes a plurality of taps 126*a*, 126*b*, 126*c*, . . . 126*n* each providing a discrete analog output voltage.

The electronic switching 114 system comprises a plurality of electronic tap switches 128. Each electronic switch 128 is connected between a first end 120*a* of the booster primary 120 and a respective one of the taps 126 for providing one of a plurality of voltages to the booster primary 120. The second end 120*b* of the booster primary 120 is connected directly to one of the taps, tap 126*m* in the example shown. With this arrangement, taps 126*a*, 126*b*, . . . , 126*m*−1 are configured to provide a voltage to the booster primary 120 which boosts or increases the output voltage of the regulator 100. The remaining taps, taps 126*m*+1, . . . , 126*n* are configured to provide a voltage to the booster primary 120 which bucks or reduces the output voltage of the regulator 100. However, it is not essential that the regulator 100 include both boost taps and buck taps. Rather, the regulator 100 may include either boost taps only, or buck taps only, without departing from the scope of the invention. Further, it is not essential that the regulator transformer secondary include a plurality of taps 126, with an electronic tap switch 128 connected to each tap 126. Instead, in lower voltage applications, the regulator transformer secondary may produce a single voltage, and the electronic switching system 114 may comprise an amplifier for providing one of a plurality of voltages to the booster primary 120.

The electronic switching system 114 also includes an electronic crowbar switch 130 connected across the booster primary 120. In the embodiment shown, each electronic switch 128, 130 comprises a pair of SCR switches connected back-to-back. However, it will be appreciated that other electronic switches, including FETs, IGBTs, GTOs, IGCTs, triacs and bipolar transistors, may be used instead of SCRs.

Figure 2:
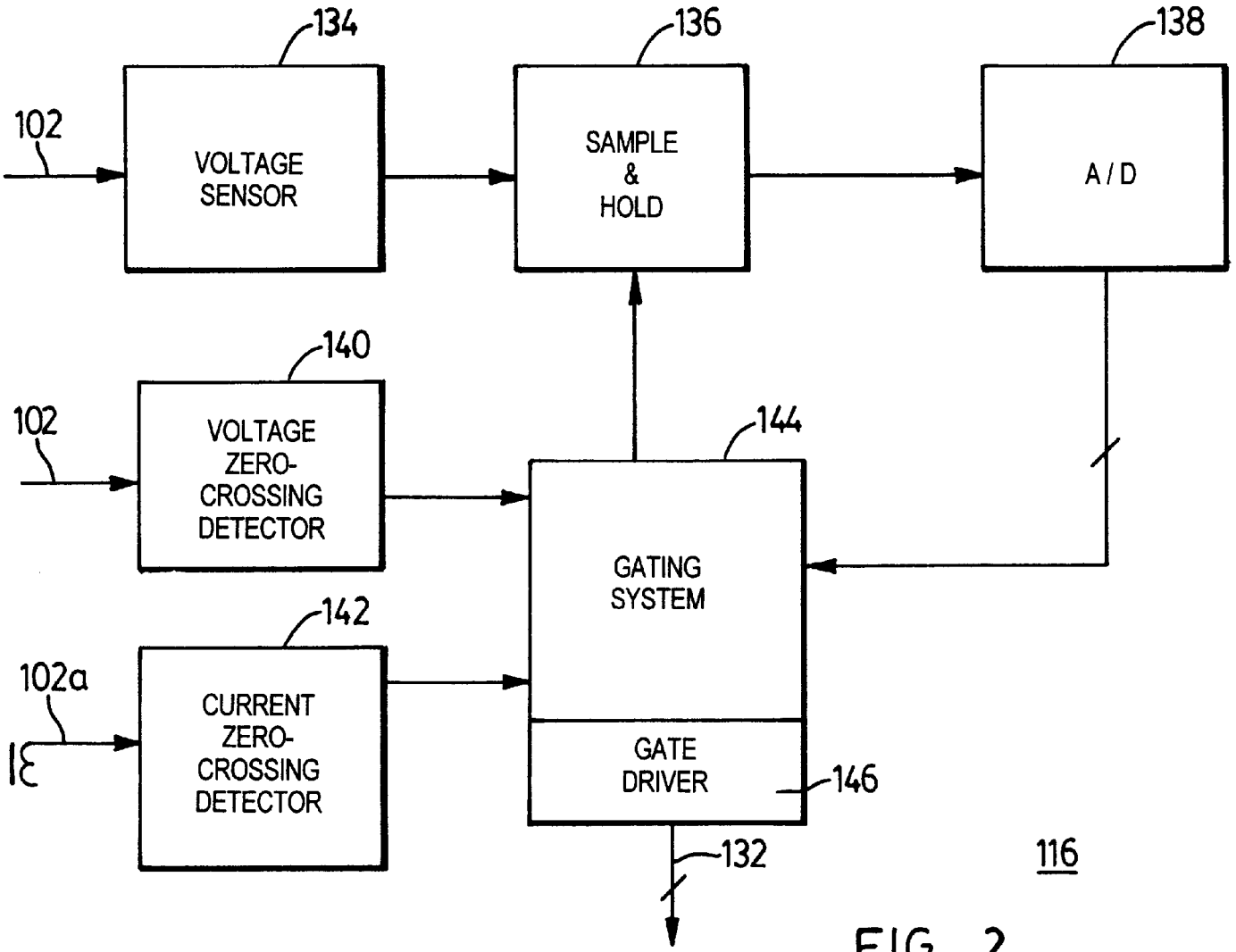
FIG. 2 is a block diagram of the control system shown in FIG. 1.

Each electronic switch 128, 130 includes a pair of gating inputs 132 for controlling a conduction interval of the switch, extending between the respective electronic switch and the control system 116. As shown in FIG. 2, the control system 116 includes an analog voltage sensor 134 for sensing a voltage at the input port 102, a sample-and-hold circuit 136 connected to the analog output of the voltage sensor 134, an analog-to-digital converter 138 connected to the output of the sample-and-hold circuit 136, a zero-crossing voltage detector 140 for detecting zero voltage crossings of the input voltage, and a zero-crossing current sensor 142 for detecting zero current crossings through the electronic switches 128, 130. Preferably, the current sensor 142 is coupled to the first end 120*a* of the booster primary 120, however it may be repositioned to other nodes of the regulator circuit if desired.

The control system 116 also comprises a microprocessor-based gating system 144 which includes an interrupt input for receiving an interrupt from the zero-crossing detector 140, a data input for receiving a control signal from the current sensor 142, a data input port for receiving digitized input voltage data from the analog-to-digital converter 138, a control output for triggering the sample-and-hold circuit 136, and a gate driver 146 connected to the gating inputs 132 of the electronic switching system 114 for switching the output voltage of the regulator 100 in response to changes in the sensed input voltage. As will be appreciated, the regulator 100 may include a separate control system 116 for each phase of the input voltage, or may include a single control system for all phases.

The notch filter 118 comprises a series RLC filter, and is connected across the booster primary 120. Two purposes of the filter 118 are to reduce notches and transients induced in the booster transformer 120 during switching dead times and to establish an initial load voltage while all the electronic switches are off. Accordingly, other suitable filter implementations will be apparent to those of ordinary skill, and are intended to fall within the scope of the invention.

In operation, the voltage sensor 134 senses the input voltage at the input port 102, preferably at a rate of 32 times per cycle of input voltage. Simultaneously, the zero-crossing detector 140 monitors the input voltage for a zero-crossing. Once a zero-crossing of the input voltage is detected, the zero-crossing detector 140 generates an interrupt to the gating system 144. Based on the fundamental frequency of the input voltage and the sample rate of the voltage sensor 134, the gating system 144 issues a command to the sample-and-hold circuit 136 which is timed so that the sample-and-hold circuit 136 samples the output of the voltage sensor 134 at the instantaneous peak value of the input voltage, each half cycle of the input voltage.

The analog output of the sample-and-hold circuit 136 is converted to digital form by the analog-to-digital converter 138, with the digitized output being input to the gating system 144. The gating system 144 compares the sensed input voltage against an expected nominal value. Based on the deviation of the sensed input voltage from the nominal value, the duration of the deviation, and the voltage regulation required by the load connected to the output port 104, the gating system 144 then carries out the steps necessary, if any, to counteract the effect an input voltage variation may have on the output voltage of the regulator 100.

If the sensed input voltage is above a minimum threshold value, preferably 90% of its nominal value, the regulator 100 is operated in no-boost mode. In this mode, the control system 116 closes the crowbar switch 130 and opens all of the tap switches 128. Consequently, during normal line voltage conditions, the booster transformer 110 appears as a short circuit between the input and output ports 102, 104, not including the leakage inductances in series with the load.

If the gating system 144 detects a drop in input voltage for a period sufficient to warrant intervention, the control system 116 first determines which tap switch 128 to close. As will be apparent, the appropriate tap switch 128 is selected so as to boost the output voltage of the generator 100 back above the minimum threshold value.

Subsequently, the control system 116 removes the gating signal from the crowbar switch 130, causing the crowbar switch 130 to open when the current through the respective SCRs drops to zero. After the current sensor 142 signals the gating system 144 that the crowbar switch 130 has stopped conducting, the gating system 144 applies a gating signal to the selected tap switch 128 before the next zero crossing of the input voltage. The magnitude of the voltage spike which would otherwise be induced across the booster transformer 120 by open-circuiting the booster primary 120 is reduced by the presence of notch filter 118. The notch filter 118 also limits the magnitude of the voltage "notch" which would otherwise be present between the instant the crowbar switch 130 is switched off and the instant the selected tap switch 128 is turned on. Further, the risk of damage to the crowbar switch 130 at turn-on which would otherwise be present as a result of the rate of change of current through the SCRs exceeding a maximum limit is reduced due to the presence of the notch filter 118, and in particular the inductive component of the notch filter 118.

If the undervoltage condition improves or worsens, the control system 116 again determines the appropriate tap 128 to close based on the deviation of the input voltage from the nominal value. After the current sensor 142 signals the gating system 144 that the conducting tap switch 128 has stopped conducting, the gating system 144 applies a gating signal to the selected tap switch 128 before the next zero crossing of the input voltage. This process continues, with the gating system 144 continuously monitoring the input voltage and determining the appropriate tap switch 128 to close each half cycle. If the undervoltage conditions disappears, the gating system 144 removes the gating signal from the conducting tap switch 128. After the current sensor 142 signals the gating system 144 that the conducting tap switch 128 has stopped conducting, the gating system 144 applies a gating signal to the crowbar switch 130 before the next zero crossing of the input voltage.

Similarly, if the gating system 144 detects a rise in input voltage above a maximum threshold value for a period sufficient to warrant intervention, the control system 116 determines which tap switch 128 to close. As will be apparent, the appropriate tap switch 128 is selected so as to reduce the output voltage of the generator 100 back below the maximum threshold value. The control system 116 then removes the gating signal from the crowbar switch 130, causing the crowbar switch 130 to open when the current through the respective SCRs drops to zero. After the current sensor 142 signals the gating system 144 that the crowbar switch 130 has stopped conducting, the gating system 144 applies a gating signal to the selected tap switch 128 before the next zero crossing of the input voltage. As a result, the regulator responds to an overvoltage condition in about one quarter of an input voltage cycle.

If the overvoltage condition improves or worsens, the control system 116 again determines the appropriate tap 128 to close based on the deviation of the input voltage from the nominal value. After the current sensor 142 signals the gating system 144 that the conducting tap switch 128 has stopped conducting, the gating system 144 applies a gating signal to the selected tap switch 128 before the next zero crossing of the input voltage. This process continues, with the gating system 144 continuously monitoring the input voltage and determining the appropriate tap switch 128 to close each half cycle. If the overvoltage conditions disappears, the gating system 144 removes the gating signal from the conducting tap switch 128. After the current sensor 142 signals the gating system 144 that the conducting tap switch 128 has stopped conducting, the gating system 144 applies a gating signal to the crowbar switch 130 before the next zero crossing of the input voltage.

In each case, it has been assumed that each selected tap switch 128 is closed continuously, at least between consecutive half cycles. Therefore, the regulator 100 responds to variations through one of a plurality of voltage steps. However, the invention is not so limited, and in one variation the electronic switches 128 comprise triac switches with the gating system 144 triggering the selected tap switch 128 with a pulse train for continuously varying the output voltage of the regulator 100 between each discrete voltage step.

Also, as discussed above, in each case the control system 116 selects the appropriate tap switch 128 to close based on the instantaneous peak value of the input voltage, each half cycle of the input voltage. Since the selected tap switch 128 is closed after the previously-conducting tap switch 128 (or crowbar switch 130) stops conducting, it will be apparent that the regulator responds to an undervoltage or overvoltage condition in about one quarter of an input voltage cycle. Also, because the regulator 100 monitors input voltage rather than output voltage, the regulator 100 is able to employ a "feed-forward" approach to voltage regulation rather than the "feed-back" approach typical of the prior art. Consequently, the regulator 100 is able to respond to input voltage variations before they impact significantly on the output voltage, generally within about 16.7 ms with a 60 Hz input voltage frequency.

The foregoing description is intended to be illustrative of the preferred embodiments of the invention. Those of ordinary skill may envisage certain additions, deletions and/or modifications to the described embodiments which, although not specifically suggested herein, do not depart from the spirit or scope of the invention as defined by the appended claims.

We claim:

1. A static voltage regulator including an input and an output, the voltage regulator comprising:

a booster transformer including a booster primary winding and a booster secondary winding, the booster secondary being provided in series with the input and the output for producing an output voltage;

a regulator transformer including a regulator primary winding and a regulator secondary winding, the regulator primary being electrically coupled to the output;

an electronic switching system coupled between the regulator secondary and the booster primary for providing a voltage to the booster primary;

a control system including a voltage sensor for sensing a voltage at the input, and a gating system coupled to the switching system for switching the output voltage in response to changes in the sensed input voltage; and a notch filter coupled to the booster transformer for reducing transients induced in the booster transformer when the output voltage is switched.

2. The static voltage regulator according to claim 1, wherein the electronic switching system comprises a plurality of electronic switches, each said electronic switch including a gating input for controlling a conduction interval thereof, and the gating system is coupled to voltage sensor and the gating inputs for selectively providing one of a plurality of voltage levels from the regulator transformer to the booster transformer in response to the sensed input voltage, the gating system being configured for opening a conducting one of the electronic switches prior to closing a non-conducting one of the electronic switches.

3. The static voltage regulator according to claim 2, wherein the voltage sensor is configured for sensing an instantaneous peak value of the input voltage, and the gating system is configured for opening the conducting one switch one-quarter cycle of the input voltage after the sensed peak.

4. The static voltage regulator according to claim 2, wherein the voltage sensor is configured for sensing an instantaneous peak value of the input voltage, and the gating system is configured for closing the non-conducting one switch after a current through the conducting one switch has ceased.

5. The static voltage regulator according to claim 2, wherein the notch filter is configured to reduce a distortion in the output voltage occurring between a first instant after the conducting one switch is opened and a second instant before the non-conducting one switch is closed.

6. The static voltage regulator according to claim 5, wherein the filter comprises a series RLC filter coupled across the booster primary.

7. The static voltage regulator according to claim 2, wherein the plurality of electronic switches includes an electronic crowbar switch coupled across the booster primary for selectively shorting the booster primary.

8. The static voltage regulator according to claim 2, wherein the regulator transformer secondary includes a plurality of voltage taps, each said electronic switch being coupled to a respective one of the taps, and the taps include a voltage boost tap for increasing the output voltage and a voltage buck tap for decreasing the output voltage.

9. A static voltage regulator including an input and an output, the voltage regulator comprising:

a booster transformer including a booster primary winding and a booster secondary winding, the booster secondary being provided in series with the input and the output for producing an output voltage;

a regulator transformer including a regulator primary winding and a regulator secondary winding, the regulator primary being electrically coupled to the output, and the regulator secondary including a plurality of voltage taps, the taps including a voltage boost tap for increasing the output voltage and a voltage buck tap for decreasing the output voltage;

an electronic switching system comprising a plurality of electronic switches, each said switch including a gating input for controlling a conduction interval thereof and being coupled between the booster primary and a respective one of the plurality of taps for providing one of a plurality of voltages to the booster primary;

a control system including a voltage sensor for sensing a voltage at the input, and a gating system coupled to the voltage sensor and the gating inputs for switching the output voltage in response to changes in the sensed input voltage, the gating system being configured to open a conducting one of the electronic switches prior to closing a non-conducting one of the electronic switches; and a notch filter coupled to the booster transformer for reducing transients induced in the booster transformer when the output voltage is switched.

10. The static voltage regulator according to claim 9, wherein the voltage sensor is configured for sensing an instantaneous peak value of the input voltage, and the gating system is configured for opening the conducting one switch one-quarter cycle of the input voltage after the sensed peak.

11. The static voltage regulator according to claim 9, wherein the voltage sensor is configured for sensing an instantaneous peak value of the input voltage, and the gating system is configured for closing the non-conducting one switch after a current through the conducting one switch has ceased.

12. The static voltage regulator according to claim 9, wherein the notch filter comprises a series RLC filter coupled across the booster primary.

13. The static voltage regulator according to claim 9, wherein the plurality of electronic switches includes an electronic crowbar switch coupled across the booster primary for selectively shorting the booster primary.

14. In a voltage regulator comprising a booster transformer including a booster primary winding and a booster secondary winding, the booster secondary being provided in series with an input and an output for producing an output voltage, a regulator transformer including a regulator primary winding and a multi-tap regulator secondary winding, the regulator primary being electrically coupled to the output, and an electronic switching system comprising a plurality of switches coupled between the booster primary and respective taps of the regulator secondary for providing a voltage to the booster primary, a method for controlling the output voltage comprising the steps of:

sensing a voltage at the input;

determining a deviation of the sensed value from an expected nominal value;

countering a variation in the output voltage arising from the deviation by opening a conducting one of the switches, and then closing a non-conducting one of the switches, the non-conducting one switch being selected in accordance with the deviation.

15. The method according to claim 14, wherein the sensing step comprising sensing an instantaneous peak value of the input voyage every half cycle of the input voltage.

16. The method according to claim 15, wherein the countering step comprises opening the conducting one switch one-quarter cycle of the input voltage after the sensed peak.

17. The method according to claim 15, wherein the countering step comprises closing the non-conducting one switch after a current through the conducting one switch has ceased.

* * * * *